United States Patent [19]

Turco et al.

[11] 4,419,318

[45] Dec. 6, 1983

[54] PROCESS FOR FORMING PROJECTILES FOR SMOOTH BORE SHOOTING GUNS

[75] Inventors: Vincenzo Turco; Antonio Pompili, both of Colleferro, Italy

[73] Assignee: Snia Viscosa Societa' Nazionale Industria Applicazioni Viscosa S.p.A., Milan, Italy

[21] Appl. No.: 199,039

[22] Filed: Oct. 20, 1980

[30] Foreign Application Priority Data

Oct. 26, 1979 [IT] Italy ..... 26831 A/79

[51] Int. Cl.[3] ..... B29C 6/00; B29D 3/00

[52] U.S. Cl. ..... 264/274; 264/275

[58] Field of Search ..... 264/271.1, 267, 275, 264/279, 261–263

[56] References Cited

U.S. PATENT DOCUMENTS 478,020 6/1892 Pollard ..... 102/526

1,153,197 9/1915 Craig ..... 102/526

4,108,074 8/1978 Billing et al. ..... 264/273

4,301,733 11/1981 Blanco ..... 102/448

*Primary Examiner*—Willard E. Hoag

*Attorney, Agent, or Firm*—Wenderoth, Lind & Ponack

[57] ABSTRACT

Method for forming a projectile for a smooth bore gun from a metal bullet, substantially made of lead, and a wad-flight control element of plastic material. The bullet is constituted by a metal body provided with an ogive with centering fins and comprises one or more cylindrical segments. The wad-flight control element comprises a container, connected to the bullet and containing the same, an amortizing portion and a cup for sealing off propellant gases. The amortizing portion and the sealing cup act to control the projectile during its flight. The bullet is positioned in a mold by the ogive and the plastic is injection molded about the bullet and inserts to define the flight control element.

4 Claims, 5 Drawing Figures

PROCESS FOR FORMING PROJECTILES FOR SMOOTH BORE SHOOTING GUNS

BACKGROUND OF THE INVENTION (a) Field of the Invention

The present invention relates to a process for forming a projectile for smooth bore hunting guns. More specifically, it relates to such a process for forming a composite projectile containing a metal part, essentially of lead, which carries out the function of a conventional bullet for smooth bore hunting guns, and a plastic material portion associated therewith, which carries out functions of wad and of flight control element.

(b) Prior Art

Projectiles for smooth bore hunting guns having various forms are known, in particular: spherical bullets; cylindrical bullets of the type called Stendebach; conic-cylindrical bullets of the Brenneke type, etc. All such types of bullets have advantages and disadvantages, but none of them is completely satisfactory, in particular from the ballistic view-point, i.e., from the view-point of precision of the shot. A bullet which has a spherical shape produces the so called "wind" between the bullet and the inside of the bores, as it is necessary that the diameter of the bullet be smaller than the caliber of the narrowest portion of the gun, such wind having a strong negative influence on the ballistic yield. The Stendebach type cylindrical bullets are strongly influenced by the tail wind and turn over in the air with negative consequences to precision, and further have other drawbacks due to their high deformability if they come into collision with foreign bodies before hitting the target. The Brenneke type conic-cylindric bullets are not sufficiently deformable in the direction of the diameter and therefore must be built with lead ribs to improve their stability, but are insufficiently precise due to an unfavorable form coefficient and inadequate stability in their trajectory.

It is to be added that the presently known bullets cannot be fired from throttled barrels or necks because of the danger that the barrels may swell out at the moment of firing. Actually, when the projectile passes through the neck, it has a friction on the inner walls of the barrel and it may be stopped for a very short instant and slowed in its travel along the axis of the barrel.

It has been proposed by some, in order to improve the ballistic yield of known bullets, to provide bullets with a flight control element, which is practically constituted by the wad of the propellant. The known wads have a sealing function with respect to the gases developed by the propellant charge and an amortizing function in the firing phase, since they are interposed between the bullet and the charge. A type of wad which may also act as flight control element for gun bullets is described in British Patent Specification No. 1,348,320. Such wad has a discoid base which seals off the propellant gases, an upper part which is destined to be connected with the bullet, and an intermediate zone provided with a discoid piece and with amortizing means positioned between the discoid piece and the previously named parts. At the moment of firing, the resistance of the wad along the axis of the cartridge is sufficient to cause its foremost portion to penetrate into a recess which is defined in the bullet and to remain firmly connected thereto to accompany it in its flight.

Such a combination of bullet and wad has considerable disadvantages, on one hand because the described wad is not per se adapted to carry out its functions with efficency, and on the other because the way in which it is connected to the bullet at the moment of firing is inefficient and requires an excessive rigidity of the wad itself, and finally because the structure of the wad is not suited to efficient operation as a flight control element.

SUMMARY OF THE INVENTION

The object of the present invention is to provide a process for forming a projectile for a smooth bore gun, whereby the projectile includes the combination of a metal bullet and a wad-flight control element of plastic material in the form of a container firmly connected to the bullet and which contains the same, an amortizing portion and a cup for sealing off the propellant gases, the amortizing portion and sealing cup also operating as the flight control element of the projectile during its flight.

The bullet is a metal body, preferably of lead which may have a cylindrical-conical form, but which may also have different forms, and which is provided with fins having a thin profile. The wad-flight control element is provided, in its container part, with external longitudinal fins.

The projectile constituted by the association of the metal bullet and of the wad-flight control element conforms to the following critical dimensional characteristics. First of all, the bullet—preferably made of antimony lead, or of any other suitable metal material—is under-dimensioned with respect to the caliber dimensions of the ball; the caliber dimensions are reached through the aforesaid container and particularly through the aforesaid plastic fins.

It is possible, but not necessary, that in order better to lock the two parts of the system together, the plastic material of which the wad-flight control element is made partly penetrate into the inside of the metal body, thereby helping the container to retain the bullet, or that the wad-flight control element be formed in such a way as to have undercut portions which retain the bullet from sliding away from the container.

At the moment of the firing, the projectile is guided while it travels through the bore, on the one hand by the propellant gases sealing cup, on the other by the amortizing part of the wad itself, a preferred form of which will be described hereinafter, and also by the plastic material fins which are located concentrically and longitudinally with respect to the axis of the projectile on the outside of the container.

This permits the use of the projectile in hunting guns both having a cylindrical barrel and having a necked barrel, because there is no possibility that a bullet be deformed by friction in the neck of the gun, which would have negative consequences on safety, and the negative result of changing the projectile shape.

The wad-flight control element, with its container, is preferably made of polyethylene.

The process of the invention for making the projectile includes injecting, preferably by pressure injection, a plastic material to form the wad-flight control element into a die wherein the bullet is positioned as an insert.

The fins of the bullet serve to center the bullet as an insert in the injection molding die.

The wad-flight control element is constituted by a container part and by a part which, taken alone, may be considered as a wad, comprising an amortizing part and a propellent gas sealing cup. The preferred structure of the wad is that which has been illustrated, for a separate wad for shot cartridges, in Italian Utility Model Application No. 21258 B/78. Such structure, which has an essentially amortizing function when used on a shot cartridge, surprisingly has been found to be particularly adapted to act as a flight control element in the present structure, in which it is a part of the projectile and travels therewith along the entire flight path. Such preferred structure is characterized by the fact that, besides comprising the gas sealing cup, which taken by itself is a common element, it also comprises two discoidal elements perpendicular to the projectile axis and a series of partitions parallel to the projectile axis and which connect the first of the two discoidal elements to the sealing cup, the second of the two discoidal elements to the bullet container, and the discoidal elements to one another. The elements which connect the two discoidal elements to one another are staggered with respect to those which connect each element, on one side with the sealing disc and on the other with the container, and have a length which is preferably smaller than the projectile radius. The structure is dimensioned in such a way that the partitions act as compressed spacing elements and remain practically underformed in the overall deformation of the wad during firing, the deformation being on the contrary constituted by the bending of the two aforesaid discoidal elements interposed between the sealing cup and the container. This behaviour is entirely opposite to those of known wads, in particular of the wad-flight control element described in the earlier British Patent Specification No. 348,320 wherein the amortizing elements, which become deformed at the moment of the firing, are those interposed between the discoidal elements perpendicular to the projectile axis.

BRIEF DESCRIPTION OF THE DRAWINGS

An embodiment of the invention will now be described for exemplary purposes, with reference to the attached drawings, wherein.

DETAILED DESCRIPTION OF THE INVENTION

Figure 2:
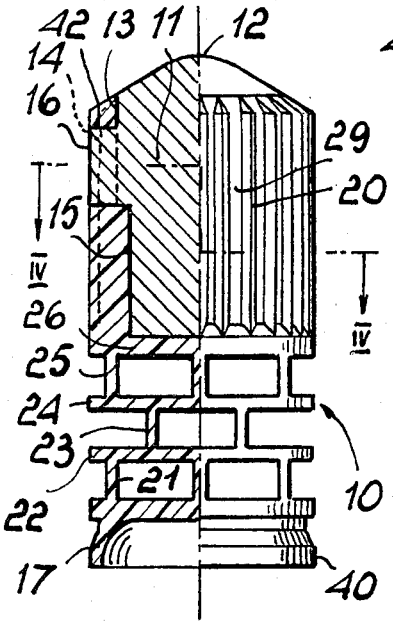
FIG. 2 is a lateral view and partly an axial cross-section of the same projectile.
Figure 3:
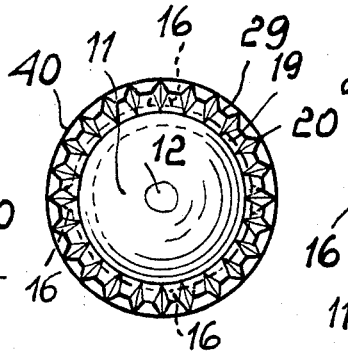
FIG. 3 is a plan view from above of the same projectile.
Figure 4:
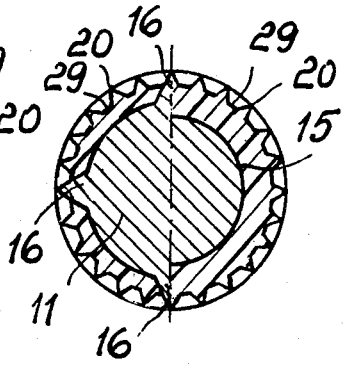
FIG. 4 is a transverse cross-section of the same projectile, taken on the two staggered planes IV—IV' indicated in FIG. 2.
Figure 1:
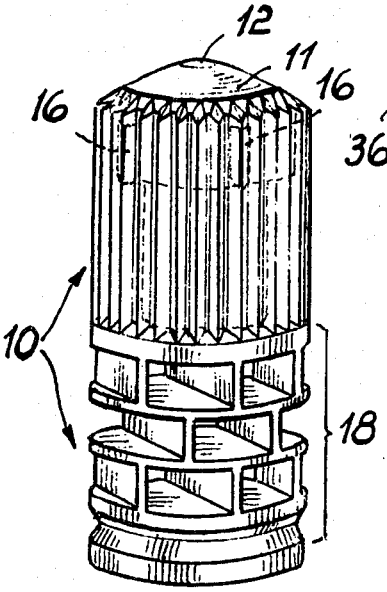
FIG. 1 is a perspective view of a projectile produced according to the process of the invention.

With reference now to FIGS. 1 to 4, the projectile comprises a metal bullet 11, partially seen in cross-section in FIGS. 2 and 4 and having an ogival point 12. Below the ogive, the bullet has a first portion having a cylindrical wall 13, therebelow it has a second portion having a cylindrical wall with a greater diameter 14, and a third cylindrical portion having a wall with minimum diameter 15. On wall 14 are formed centering fins 16, the function of which will be described hereinafter.

A wad-flight control element is generally indicated at 10 and comprises, from the bottom to the top, a cup 17 for sealing the discharge gases and which also acts as a projectile flight control element, an intermediate amortizing portion 18 having a reticular structure as will be discussed below, and thereabove a container 19 externally provided with ribs 20 and internally shaped in a way corresponding to the shape of the bullet.

The intermediate amortizing part 18 is constituted by a series of partitions positioned in planes parallel to the projectile axis and a series of discoidal elements or diaphragms, located in perpendicular planes. The first partitions 21, which are three, are connected to the sealing cup 17 and to a disc 22, the second partitions 23, which are two, are connected to disc 22 and to a disc 24, and the third partitions 25, which are also three, are connected to the disc 24 and to the discoidal bottom 26 of container 19. The shape of the amortizing part is not new per se, since it is similar to those already used in separate wads for shot cartridges, as in the cited previous utility model application, however it acquires in this projectile a new function and achieves a new technical effect.

Figure 5:
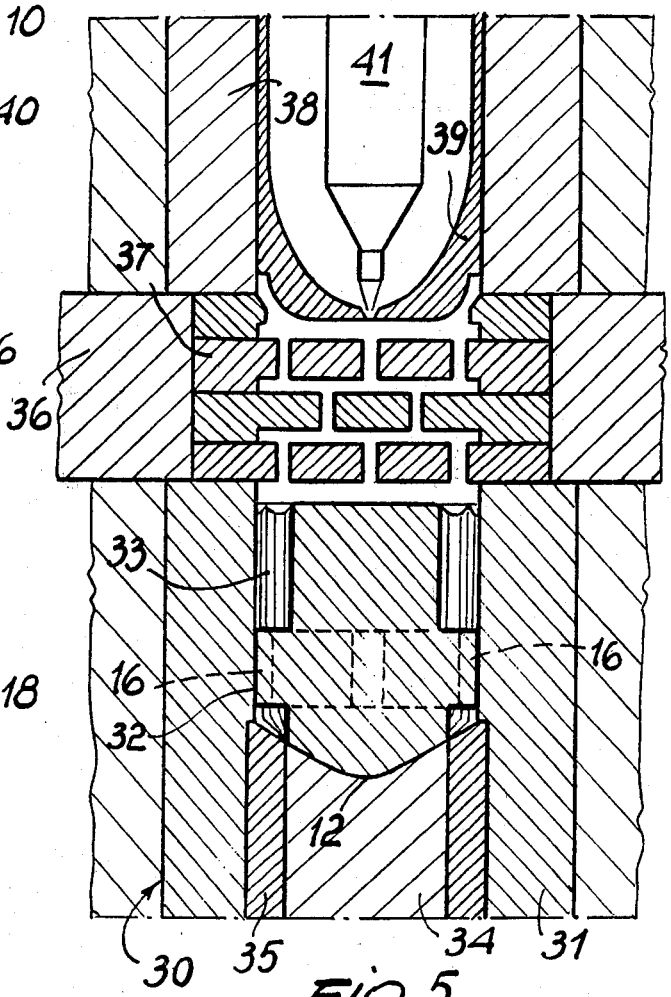
FIG. 5 is a schematic illustration of the process of the invention for manufacturing the projectile.

The projectile which is the object of the invention is made as illustrated in FIG. 5, in the following way.

A die, generally indicated at 30, comprises, from the bottom to the top in FIG. 5, a cylindrical element 31 which defines the cylindrical surface which externally envelops the projectile, and on the inner wall of which the fins 16 of the bullet are centered at 32 to position the bullet within the die. The upper part of element 31 is provided with projections 33 which define depressions 29 of container 19. The ogive 12 of the bullet rests on an element 34, while an element 35 defines the upper edge of container 19.

Above (with respect to FIG. 5) the portion of the die which has been described, a cylindrical element 36 is positioned, wherein pieces 37 are located which have various shapes and determine void zones to form the amortizing portion 18 of wad-flight control element 10, elements 37 being in a number and of the configuration which are necessary to permit their extraction after the die casting operation. Further above, an element 38 is positioned, internally of which is positioned a core 39 which defines the lower surface of the cup 17, the lower lateral edges 40 whereof (FIG. 2) are defined by the inner surface of element 38. Numeral 41 indicates a nozzle for conveying the plastic material.

In order to manufacture the projectile, the element 31 is positioned with the parts cooperating therewith and the bullet is set in place, the position of the bullet being determined by the abutment of its ogive and by the centering of the fins 16. Thereafter the assemblage of the die is completed and finally the plastic material is introduced and fills all the empty spaces, thereby to define the wad-flight control element.

The plastic material is obviously any convenient thermoplastic material, conveniently a polyolefin, such as polyethylene, polypropylene or any other suitable material.

The natural shrinkage of the plastic material after the die casting operation serves firmly to lock the bullet within the container and to retain it therein, said bullet being even more firmly retained because of the fact that its cylindrical portion 14 and the fins 16 abut with a shoulder 42 (FIG. 2)) of the container.

We claim:

1. A process for forming a projectile for use in a smooth bore gun and of the type including a combined metal bullet and a wad-flight control element formed of a plastic material, said process comprising:

forming a metal bullet having a front end of ogival configuration, a rear end, and at least one cylindrical intermediate section having extending therefrom fins;

positioning said bullet in a die and centering said bullet therein by contacting the ogive of said front end and said fins with respective first and second inner surfaces of said die, while maintaining a generally annular space around said cylindrical section, between said cylindrical section and said second inner surface of said die;

positioning adjacent said rear end of said bullet within said die a plurality of die inserts of a configuration to define therebetween a reticulated space in communication with said annular space and a cup-shaped space in communication with said reticulated space and facing away therefrom; and injecting plastic material into and filling said cup-shaped space, said reticulated space and said annular space, thereby fixedly forming on said metal bullet a plastic wad-flight control element including a container portion fixed to and surrounding said bullet and formed from plastic injected into said annular space, a reticulated portion integral with and extending rearwardly from said container portion and formed from plastic injected into said reticulated space, and a sealing cup portion integral with and extending rearwardly from said reticulated portion and formed from plastic injected into said cup-shaped space.

2. A process as claimed in claim 1, wherein said injecting comprises pressure injection.

3. A process as claimed in claim 1, comprising forming said annular space both forwardly and rearwardly of said fins, whereby said plastic forming said container portion grips said fins on opposite axial ends thereof.

4. A process as claimed in claim 1, wherein said bullet is formed of lead and said plastic material comprises polyethylene.

* * * * *